US010272676B2

(12) United States Patent
Yamagata et al.

(10) Patent No.: US 10,272,676 B2
(45) **Date of Patent: *Apr. 30, 2019**

(54) LIQUID EJECTING DEVICE, HEAD UNIT, AND LIQUID EJECTING METHOD

(71) Applicants: Seiko Epson Corporation, Shinjuku-ku (JP); SCREEN Holdings Co., Ltd., Kyoto-shi (JP)

(72) Inventors: Toshiyuki Yamagata, Matsumoto (JP); Toshiki Usui, Shiojiri (JP); Naoki Yonekubo, Shiojiri (JP); Kiyoomi Mitsuki, Kyoto (JP)

(73) Assignees: Seiko Epson Corporation, Tokyo (JP); SCREEN Holdings Co., Ltd., Kyoto (JP)

( * ) Notice: Subject to any disclaimer, the term of this patent is extended or adjusted under 35 U.S.C. 154(b) by 6 days.

This patent is subject to a terminal disclaimer.

(21) Appl. No.: 15/293,144

(22) Filed: Oct. 13, 2016

(65) Prior Publication Data

US 2017/0028716 A1 Feb. 2, 2017

Related U.S. Application Data

(63) Continuation of application No. 14/498,764, filed on Sep. 26, 2014.

(30) Foreign Application Priority Data

Sep. 27, 2013 (JP) ..... 2013-202202

(51) Int. Cl.
*B41J 2/045* (2006.01)

(52) U.S. Cl.
CPC ..... *B41J 2/04588* (2013.01); *B41J 2/04573* (2013.01); *B41J 2/04581* (2013.01)

(58) Field of Classification Search
CPC . B41J 2/04588; B41J 2/04573; B41J 2/04581
See application file for complete search history.

(56) References Cited

U.S. PATENT DOCUMENTS 6,053,596 A 4/2000 Nakano et al.
6,328,395 B1 * 12/2001 Kitahara ..... B41J 2/04541 347/15

(Continued)

FOREIGN PATENT DOCUMENTS

JP 10-278266 A 10/1998
JP 2006-212920 A 8/2006

(Continued)

OTHER PUBLICATIONS

Non-Final Office Action dated Oct. 6, 2015 in related case U.S. Appl. No. 14/498,764, filed Sep. 26, 2014 (12 pages).

(Continued)

*Primary Examiner* — Justin Seo
(74) *Attorney, Agent, or Firm* — Kilpatrick Townsend & Stockton LLP

(57) ABSTRACT

A liquid ejecting device includes: a piezoelectric element that is deformed by applying at least one drive waveform among a plurality of drive waveforms to the piezoelectric element, the plurality of drive waveforms including a first drive waveform and a second drive waveform; a cavity that is filled with a liquid and is increased or decreased in internal pressure due to deformation of the piezoelectric element; a nozzle that communicates with the cavity, and ejects the liquid as a liquid droplet; and a selection section that selects at least one drive waveform from the plurality of drive waveforms, the liquid droplet including a first liquid droplet ejected when the first drive waveform has been selected, and a second liquid droplet ejected when the second drive waveform has been selected, an ejection volume of the first (Continued)

liquid droplet being almost equal to an ejection volume of the second liquid droplet.

5 Claims, 11 Drawing Sheets

(56) References Cited

U.S. PATENT DOCUMENTS

| | | | | |
|---|---|---|---|---|
| 2003/0227519 | A1* | 12/2003 | Ikeda | B41J 2/04541 347/68 |
| 2006/0192797 | A1 | 8/2006 | Hosono | |
| 2007/0097163 | A1* | 5/2007 | Shingyohuchi | B41J 2/04573 347/15 |
| 2009/0189936 | A1 | 7/2009 | Tamura | |
| 2009/0278877 | A1* | 11/2009 | Kimura | B41J 2/04581 347/10 |
| 2011/0096111 | A1* | 4/2011 | Matsuo | B41J 2/04581 347/10 |
| 2015/0091961 | A1 | 4/2015 | Yamagata et al. | |

FOREIGN PATENT DOCUMENTS

| | | | |
|---|---|---|---|
| JP | 2006-212947 | A | 8/2006 |
| JP | 2010-188695 | A | 9/2010 |

OTHER PUBLICATIONS

Final Office Action dated Mar. 10, 2016 in related case U.S. Appl. No. 14/498,764, filed Sep. 26, 2014 (12 pages).

* cited by examiner

LIQUID EJECTING DEVICE, HEAD UNIT, AND LIQUID EJECTING METHOD

This application is a continuation of, and claims priority to, U.S. patent application Ser. No. 14/498,764 filed on Sep. 26, 2014 which claims priority to Japanese Patent Application No. 2013-202202 filed on Sep. 27, 2013, the entirety of which are hereby incorporated by reference.

BACKGROUND OF THE INVENTION

The present invention relates to a liquid ejecting device, a head unit, and a liquid ejecting method.

A liquid ejecting device is a device that includes a liquid ejecting head (hereinafter referred to as "head") that can eject various types of liquid. Examples of a typical liquid ejecting device include an image recording device such as a liquid-jet printing device (printer) that ejects a liquid ink onto a recording medium (placement target) such as recording paper from a nozzle provided to the head to record an image and the like.

It is important to design a liquid-jet printing device and the like so that a variation in ejection properties (e.g., a variation in the number of nozzles that simultaneously eject the ink, and a variation in the liquid travel speed and the liquid weight depending on the position of the nozzle) is reduced in order to improve the quality of the product. For example, JP-A-2010-188695 reduces a variation in ejection properties by driving the corresponding pressure-generating elements using a first drive waveform when the number of nozzles that simultaneously eject the ink is equal to or less than a predetermined threshold value, and driving the pressure-generating elements corresponding to the end nozzle group using the first drive waveform, and driving the pressure-generating elements corresponding to the center nozzle group using a second drive waveform when the number of nozzles that simultaneously eject the ink has exceeded the threshold value.

Even when a liquid droplet having an identical volume is ejected from the nozzle, residual vibrations after ejection may affect the subsequent ejection, and the placement timing may differ between the case where the first liquid droplet is ejected (first ejection) and the case where the second or subsequent liquid droplet is ejected (subsequent ejection). In particular, since it is difficult to provide an ejection interval that ensures that the residual vibrations stop when liquid droplets are ejected at high speed for implementing high-speed printing, the placement timing is significantly affected. When providing an additional drive signal having the drive waveform for the first ejection, it is necessary to additionally provide a drive signal generation section. This is not a practical solution since the circuit scale increases to a large extent.

SUMMARY

Several aspects of the invention may provide a liquid ejecting device, a head unit, and a liquid ejecting method that can improve the quality of the product by adjusting the placement timing of the first liquid droplet (first ejection) and the second liquid droplet (subsequent ejection) without increasing the circuit scale.

According to a first aspect of the invention, there is provided a liquid ejecting device including:

a piezoelectric element that is deformed by applying at least one drive waveform among a plurality of drive waveforms to the piezoelectric element, the plurality of drive waveforms including a first drive waveform and a second drive waveform that differs from the first drive waveform;

a cavity that is filled with a liquid and is increased or decreased in internal pressure due to deformation of the piezoelectric element;

a nozzle that communicates with the cavity and ejects the liquid as a liquid droplet through increase and decrease in the internal pressure of the cavity; and a selection section that selects at least one drive waveform from the plurality of drive waveforms, and applies a selected drive waveform to the piezoelectric element, the liquid droplet ejected from the nozzle including a first liquid droplet ejected when the first drive waveform has been selected by the selection section and applied to the piezoelectric element, and a second liquid droplet ejected when the second drive waveform has been selected by the selection section and applied to the piezoelectric element, an ejection volume of the first liquid droplet being almost equal to an ejection volume of the second liquid droplet.

According to a second aspect of the invention, there is provided a head unit including:

a piezoelectric element that is deformed by applying at least one drive waveform among a plurality of drive waveforms to the piezoelectric element, the plurality of drive waveforms including a first drive waveform and a second drive waveform that differs from the first drive waveform;

a cavity that is filled with a liquid and is increased or decreased in internal pressure due to deformation of the piezoelectric element;

a nozzle that communicates with the cavity and ejects the liquid as a liquid droplet through increase and decrease in the internal pressure of the cavity; and a selection section that selects at least one drive waveform from the plurality of drive waveforms, and applies a selected drive waveform to the piezoelectric element, the liquid droplet ejected from the nozzle including a first liquid droplet ejected when the first drive waveform has been selected by the selection section and applied to the piezoelectric element, and a second liquid droplet ejected when the second drive waveform has been selected by the selection section and applied to the piezoelectric element, an ejection volume of the first liquid droplet being almost equal to an ejection volume of the second liquid droplet.

According to a third aspect of the invention, there is provided a liquid ejecting method for a liquid ejecting device that includes a piezoelectric element that is deformed by applying at least one drive waveform among a plurality of drive waveforms to the piezoelectric element, the plurality of drive waveforms including a first drive waveform and a second drive waveform that differs from the first drive waveform, a cavity that is filled with a liquid and is increased or decreased in internal pressure due to deformation of the piezoelectric element, and a nozzle that communicates with the cavity and ejects the liquid as a liquid droplet through increase and decrease in the internal pressure of the cavity, the liquid ejecting method including:

selecting whether to eject a first liquid droplet or a second liquid droplet from the nozzle, an ejection volume of the first liquid droplet being almost equal to an ejection volume of the second liquid droplet;

applying the first drive waveform to the piezoelectric element when ejecting the first liquid droplet; and applying the second drive waveform to the piezoelectric element when ejecting the second liquid droplet.

Figure 1:
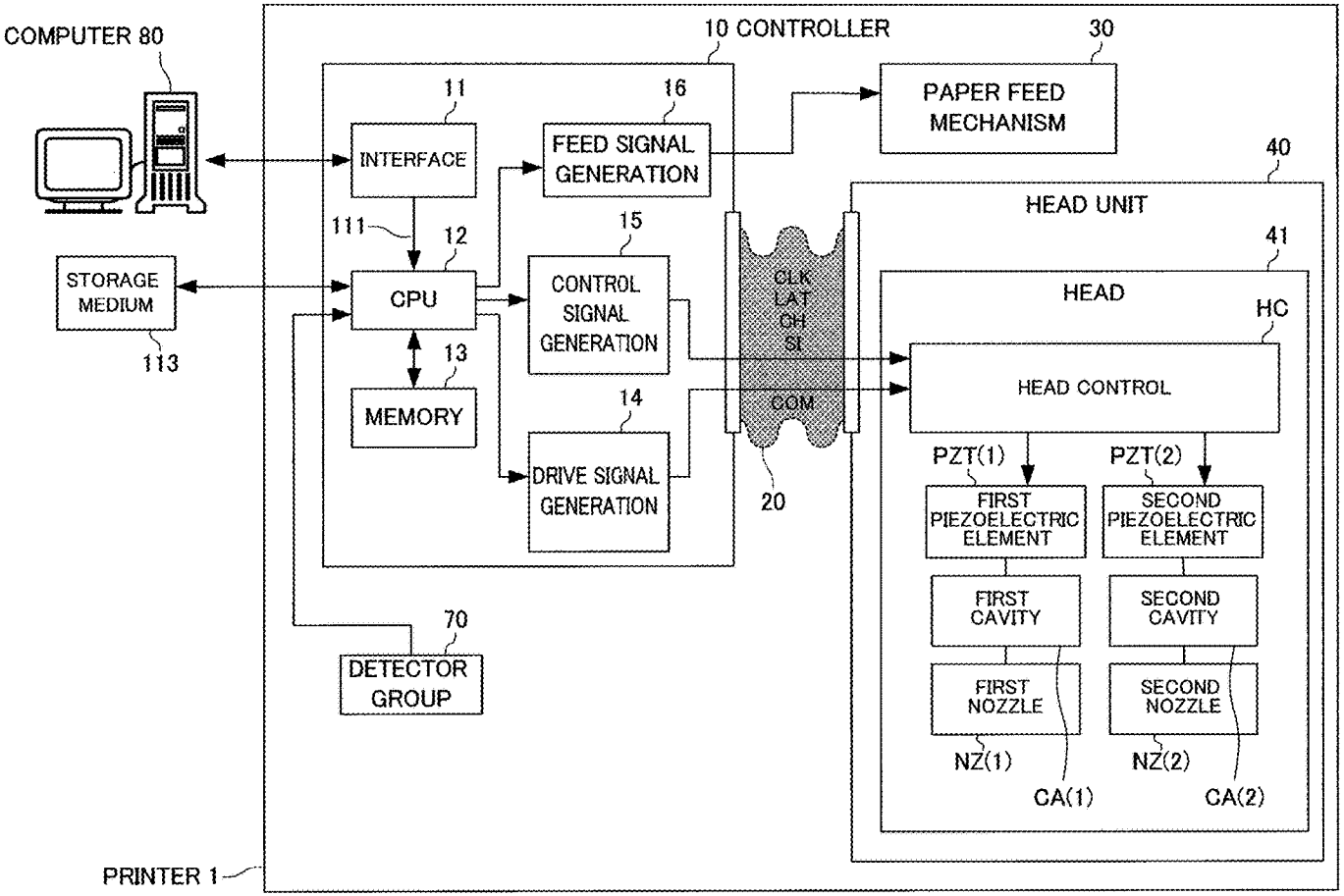
FIG. 1 is a block diagram illustrating the overall configuration of a printing system.

DETAILED DESCRIPTION OF THE EMBODIMENT (1) According to one embodiment of the invention, a liquid ejecting device includes:

a piezoelectric element that is deformed by applying at least one drive waveform among a plurality of drive waveforms to the piezoelectric element, the plurality of drive waveforms including a first drive waveform and a second drive waveform that differs from the first drive waveform;

a cavity that is filled with a liquid and is increased or decreased in internal pressure due to deformation of the piezoelectric element;

a nozzle that communicates with the cavity and ejects the liquid as a liquid droplet through increase and decrease in the internal pressure of the cavity; and a selection section that selects at least one drive waveform from the plurality of drive waveforms, and applies a selected drive waveform to the piezoelectric element, the liquid droplet ejected from the nozzle including a first liquid droplet ejected when the first drive waveform has been selected by the selection section and applied to the piezoelectric element, and a second liquid droplet ejected when the second drive waveform has been selected by the selection section and applied to the piezoelectric element, an ejection volume of the first liquid droplet being almost equal to an ejection volume of the second liquid droplet.

Even when a liquid droplet having an identical volume is ejected from the nozzle, residual vibrations after ejection may affect the subsequent ejection, and the placement timing may differ between the case where the first liquid droplet is ejected (hereinafter may be referred to as "first ejection") and the case where the second or subsequent liquid droplet is ejected (hereinafter may be referred to as "subsequent ejection"). In particular, since it is difficult to provide an ejection interval that ensures that the residual vibrations stop when liquid droplets are ejected at high speed for implementing high-speed printing, the placement timing is significantly affected.

The liquid ejecting device according to one embodiment of the invention ejects the first liquid droplet (corresponding to the first ejection, for example) when the first drive waveform has been applied to the piezoelectric element, and ejects the second liquid droplet (corresponding to the subsequent ejection, for example) when the second drive waveform has been applied to the piezoelectric element. Therefore, it is possible to adjust the placement timing of the first ejection and the subsequent ejection.

Since the first drive waveform and the second drive waveform are part of the drive signal, it is unnecessary to separately provide the drive signals corresponding to the first ejection and the subsequent ejection. Therefore, it is possible to implement a stable ejection control process, and improve the quality of the product while avoiding a decrease in the degree of freedom of design and an increase in circuit scale (i.e., without increasing the number of drive signals). Note that the ejection volume of the first liquid droplet is almost equal to the ejection volume of the second liquid droplet when the first liquid droplet and the second liquid droplet are considered to be the same type of ink droplet. For example, when a large ink droplet that can form a large dot, and a medium ink droplet that can form a medium dot are ejected, the ejection volume of the first liquid droplet and the ejection volume of the second liquid droplet are equal to each other to such an extent that both the first liquid droplet and the second liquid droplet can form a large dot (i.e., a medium dot is not formed by the first liquid droplet and the second liquid droplet).

(2) In the liquid ejecting device, the second liquid droplet may be ejected from the nozzle after the first liquid droplet has been ejected.

The second liquid droplet is affected by residual vibrations due to ejection of the first liquid droplet. However, the liquid ejecting device according to one embodiment of the invention ejects the first liquid droplet when the first drive waveform has been applied to the piezoelectric element, and ejects the second liquid droplet when the second drive waveform has been applied to the piezoelectric element. Specifically, since the drive waveform applied to the piezoelectric element when ejecting the first liquid droplet differs from the drive waveform applied to the piezoelectric element when ejecting the second liquid droplet although the ejection volume is identical, the placement timing of the first ejection and the subsequent ejection can be adjusted, and it is possible to implement a stable ejection control process, and improve the quality of the product.

(3) In the liquid ejecting device, the nozzle may eject no liquid droplet at an ejection timing that precedes an ejection timing for the first liquid droplet.

When the liquid droplet is not ejected from the nozzle at an ejection timing that precedes the ejection timing of the first liquid droplet, the first liquid droplet is not affected by residual vibrations. Therefore, the first liquid droplet differs in placement timing from the second liquid droplet. The liquid ejecting device according to one embodiment of the invention ejects the first liquid droplet when the first drive waveform has been applied to the piezoelectric element, and ejects the second liquid droplet when the second drive waveform has been applied to the piezoelectric element. Specifically, since the drive waveform applied to the piezoelectric element when ejecting the first liquid droplet differs from the drive waveform applied to the piezoelectric element when ejecting the second liquid droplet although the ejection volume is identical, the placement timing of the first ejection and the subsequent ejection can be adjusted, and it is possible to implement a stable ejection control process, and improve the quality of the product.

(4) In the liquid ejecting device, the liquid droplet ejected from the nozzle may also include a third liquid droplet, and the ejection volume of the first liquid droplet and the ejection volume of the second liquid droplet may be respectively larger than an ejection volume of the third liquid droplet.

Specifically, the third liquid droplet for which the ejection volume is smaller than those of the first liquid droplet and the second liquid droplet is also ejected from the nozzle included in the liquid ejecting device according to one embodiment of the invention. For example, when the liquid ejecting device according to one embodiment of the invention is a liquid-jet printing device, the first liquid droplet and the second liquid droplet are a large ink droplet that can form a large dot, and the third liquid droplet is a medium (or small) ink droplet that can form a medium (or small) dot. When the ejection volume of the first liquid droplet and the ejection volume of the second liquid droplet are large, a significant shift in dot position occurs in the product if the placement timing varies due to residual vibrations. Specifically, the quality of the product is affected to a large extent. Since the liquid ejecting device according to one embodiment of the invention can implement a stable ejection control process so that a significant shift in dot position does not occur, the liquid ejecting device can significantly improve the quality of the product.

(5) In the liquid ejecting device, the piezoelectric element may be displaced by selectively applying part or the entirety of a first drive signal and part or the entirety of a second drive signal that differs from the first drive signal to the piezoelectric element, the first drive signal may have a first holding part that holds a predetermined potential, the first holding part may include a first part and a second part that follows the first part, the second drive signal may have a second holding part that holds the predetermined potential, the second holding part may include a third part and a fourth part that follows the third part, the third part differing in period from the first part, the first liquid droplet may be ejected from the nozzle when the first drive waveform including the third part and the second part has been applied to the piezoelectric element, and the second liquid droplet may be ejected from the nozzle when the second drive waveform including the first part and the second part has been applied to the piezoelectric element.

The liquid ejecting device according to one embodiment of the invention can generate the drive signal applied to the piezoelectric element by selecting the first drive signal or the second drive signal. In this case, it is possible to combine part of the first drive signal and part of the second drive signal. The first drive signal and the second drive signal respectively include the holding part that holds the predetermined potential, and includes two parts. Therefore, the first drive waveform and the second drive waveform can be easily implemented by part of the first drive signal and part of the second drive signal by dividing the first drive signal and the second drive signal utilizing the holding part. In this case, since the drive signal is switched at the same potential (predetermined potential), a change in potential does not occur when switching the drive signal. Since the first drive signal and the second drive signal are not drive signals dedicated to the first ejection and the subsequent ejection, and a drive waveform obtained by combining the first drive signal and the second drive signal can be used, it is possible to increase the degree of freedom of design, and implement a stable ejection control process to improve the quality of the product.

(6) In the liquid ejecting device, the volume of the cavity in a state in which the predetermined potential is applied to the piezoelectric element may be larger than the volume of the cavity in a state in which a potential other than the predetermined potential is applied to the piezoelectric element.

The liquid ejecting device according to one embodiment of the invention switches the drive signal between the first drive signal and the second drive signal in a state in which the volume of the cavity is large. Therefore, the placement timing of the liquid droplet that is ejected after the drive signal has been switched can be appropriately controlled while preventing a situation in which the ejection operation is affected by switching (e.g., a situation in which noise is applied to the drive waveform).

(7) According to one embodiment of the invention, a head unit includes:

a piezoelectric element that is deformed by applying at least one drive waveform among a plurality of drive waveforms to the piezoelectric element, the plurality of drive waveforms including a first drive waveform and a second drive waveform that differs from the first drive waveform;

a cavity that is filled with a liquid and is increased or decreased in internal pressure due to deformation of the piezoelectric element;

a nozzle that communicates with the cavity and ejects the liquid as a liquid droplet through increase and decrease in the internal pressure of the cavity; and a selection section that selects at least one drive waveform from the plurality of drive waveforms, and applies a selected drive waveform to the piezoelectric element, the liquid droplet ejected from the nozzle including a first liquid droplet ejected when the first drive waveform has been selected by the selection section and applied to the piezoelectric element, and a second liquid droplet ejected when the second drive waveform has been selected by the selection section and applied to the piezoelectric element, an ejection volume of the first liquid droplet being almost equal to an ejection volume of the second liquid droplet.

The head unit according to one embodiment of the invention ejects the first liquid droplet (corresponding to the first ejection, for example) when the first drive waveform has been applied to the piezoelectric element, and ejects the second liquid droplet (corresponding to the subsequent ejection, for example) when the second drive waveform has been applied to the piezoelectric element. Therefore, it is possible to adjust the placement timing of the first ejection and the subsequent ejection.

Since the first drive waveform and the second drive waveform are part of the drive signal, it is unnecessary to separately provide the drive signals corresponding to the first ejection and the subsequent ejection. Therefore, a liquid ejecting device that utilizes the head unit according to one embodiment of the invention can implement a stable ejection control process, and improve the quality of the product while avoiding a decrease in the degree of freedom of design and an increase in circuit scale (i.e., without increasing the number of drive signals).

(8) According to one embodiment of the invention, a liquid ejecting method is used for a liquid ejecting device that includes a piezoelectric element that is deformed by applying at least one drive waveform among a plurality of drive waveforms to the piezoelectric element, the plurality of drive waveforms including a first drive waveform and a second drive waveform that differs from the first drive waveform, a cavity that is filled with a liquid and is increased or decreased in internal pressure due to deformation of the piezoelectric element, and a nozzle that communicates with the cavity and ejects the liquid as a liquid droplet through increase and decrease in the internal pressure of the cavity, the liquid ejecting method including:

selecting whether to eject a first liquid droplet or a second liquid droplet from the nozzle, an ejection volume of the first liquid droplet being almost equal to an ejection volume of the second liquid droplet;

applying the first drive waveform to the piezoelectric element when ejecting the first liquid droplet; and applying the second drive waveform to the piezoelectric element when ejecting the second liquid droplet.

The liquid ejecting method according to one embodiment of the invention selects whether to eject the first liquid droplet (corresponding to the first ejection, for example) or the second liquid droplet (corresponding to the subsequent ejection, for example), and applies a different drive waveform to the piezoelectric element corresponding to the first liquid droplet and the second liquid droplet. Therefore, a liquid ejecting device that performs a control process according to the liquid ejecting method according to one embodiment of the invention can adjust the placement timing of the first ejection and the subsequent ejection. Specifically, the liquid ejecting method according to one embodiment of the invention can implement a liquid ejecting device that implements a stable ejection control process, and improves the quality of the product.

1. Configuration of Printing System

A liquid ejecting device according to one embodiment of the invention is described below taking a liquid-jet printing device as an example.

FIG. 1 is a block diagram illustrating the overall configuration of a printing system that includes a liquid-jet printing device (printer 1) according to one embodiment of the invention. The printer 1 is a line head printer that feeds paper S (see FIGS. 2 and 3) in a predetermined direction, and prints an image on the paper S in a printing area while the paper S is being fed (described later).

The printer 1 is communicably connected to the computer 80. A printer driver installed in the computer 80 generates print data that causes the printer 1 to print an image, and outputs the print data to the printer 1. The printer 1 includes a controller 10, a paper feed mechanism 30, a head unit 40, and a detector group 70. Note that the printer 1 may include a plurality of head units 40 (as described later). In FIG. 1, one head unit 40 is illustrated for convenience of explanation.

The controller 10 included in the printer 1 controls the entire printer 1. An interface section 11 exchanges data with the computer 80 (i.e., external device). The interface section 11 outputs print data 111 received from the computer 80 to a CPU 12. The print data 111 includes image data, data that designates a print mode, and the like.

The CPU 12 is a processing unit for controlling the entire printer 1. The CPU 12 controls the head unit 40 and the paper feed mechanism 30 through a drive signal generation section 14, a control signal generation section 15, and a feed signal generation section 16. A memory 13 stores a program and data for the CPU 12, and serves as a work area, for example. The state of the printer 1 is monitored by the detector group 70, and the controller 10 controls the printer 1 based on the detection results of the detector group 70. Note that the program and the data for the CPU 12 may be stored in a storage medium 113. The storage medium 113 may be a magnetic disk (e.g., hard disk), an optical disk (e.g., DVD), a nonvolatile memory (e.g., flash memory), or the like. Note that the storage medium 113 is not particularly limited. The CPU 12 may be accessible to the storage medium 113 connected to the printer 1 (see FIG. 1). The storage medium 113 may be connected to the computer 80, and the CPU 12 may be accessible to the storage medium 113 through the interface section 11 and the computer 80. Note that the path used in such a case is not illustrated in FIG. 1.

The drive signal generation section 14 generates a drive signal COM that displaces a piezoelectric element PZT included in a head 41. The drive signal generation section 14 includes a waveform generation circuit and a power amplifier circuit (described later) (see FIG. 5). The drive signal generation section 14 generates an original drive signal (i.e., an original signal of the drive signal COM) using the waveform generation circuit, and amplifies the original drive signal using the power amplifier circuit according to instructions from the CPU 12 to generate the drive signal COM. Note that a modulation process and a demodulation process may be performed when generating the drive signal COM.

The control signal generation section 15 generates a control signal according to instructions from the CPU 12. The control signal is a signal that is used to control the head 41 (e.g., a signal that selects a nozzle from which the liquid is discharged). In one embodiment of the invention, the control signal generation section 15 generates the control signal including a clock signal CLK, a latch signal LAT, a channel signal CH, and pixel data SI. Note that the details of these signals are described later. The control signal generation section 15 may be included in the CPU 12 (i.e., the CPU 12 may implement the function of the control signal generation section 15).

The drive signal COM generated by the drive signal generation section 14 is an analog signal that continuously changes in voltage, and the clock signal CLK, the latch signal LAT, the channel signal CH, and the pixel data SI (control signals) are digital signals. The drive signal COM and the control signal are transmitted to the head 41 of the head unit 40 through a cable 20 that is a flexible flat cable (hereinafter referred to as "FFC"). A plurality of control signals may be transmitted by time division using a differential serial method. In this case, the number of transmission lines can be reduced as compared with the case of transmitting each control signal in parallel. Therefore, it is possible to prevent a deterioration in sliding properties due to the use of a number of FFC, and reduce the size of a connector provided to the controller 10 and the head unit 40.

The feed signal generation section 16 generates a signal that controls the paper feed mechanism 30 according to instructions from the CPU 12. The paper feed mechanism 30 rotatably supports the paper S that is rolled, for example. The paper feed mechanism 30 feeds (rotates) the paper S so that predetermined characters, image, and the like are printed on the paper S in the printing area. For example, the paper feed mechanism 30 feeds the paper S in the predetermined direction based on the signal generated by the feed signal generation section 16. Note that the feed signal generation section 16 may be included in the CPU 12 (i.e., the CPU 12 may implement the function of the feed signal generation section 16).

The head unit 40 includes the head 41 (liquid ejecting section). In FIG. 1, only one head 41 is illustrated for convenience of illustration. The head unit 40 may include a plurality of heads 41. The head 41 includes at least two actuator sections that respectively include the piezoelectric element PZT, a cavity CA, and a nozzle NZ. The head 41 also includes a head control section HC that controls displacement (deformation) of the piezoelectric element PZT. The actuator section includes the piezoelectric element PZT that can be displaced using the drive signal COM, the cavity CA that is filled with a liquid, and is increased or decreased in internal pressure due to displacement of the piezoelectric element PZT, and the nozzle NZ that ejects the liquid as a liquid droplet through an increase and a decrease in the internal pressure of the cavity CA. The head control section HC controls displacement of the piezoelectric element PZT based on the drive signal COM and the control signal from the controller 10.

The elements included in each actuator section are distinguished by adding a numeral in parenthesis to the reference sign. In the example illustrated in FIG. 1 in which two actuator sections are provided, a first actuator section includes a first piezoelectric element PZT(1), a first cavity CA(1), and a first nozzle NZ(1), and a second actuator section includes a second piezoelectric element PZT(2), a second cavity CA(2), and a second nozzle NZ(2). Note that the number of actuator sections is not limited to two, and three or more actuator sections may be provided. In FIG. 1, the first actuator section and the second actuator section are included in one head 41 for convenience of illustration. Note that the first actuator section or the second actuator section may be included in another head 41.

The drive signal COM is generated by the drive signal generation section 14, and transmitted to the first piezoelectric element PZT(1) and the second piezoelectric element PZT(2) through the cable 20 and the head control section HC (see FIG. 1). The control signal including the clock signal CLK, the latch signal LAT, the channel signal CH, and the pixel data SI is generated by the control signal generation section 15, and transmitted to the head control section HC through the cable 20 (see FIG. 1). Note that the drive signal COM is not limited to one signal. In the printer 1 according to one embodiment of the invention, the drive signal COM includes a plurality of signals (first drive signal COM_A and second drive signal COM_B) (described later).

2. Configuration of Printer

Figure 2:
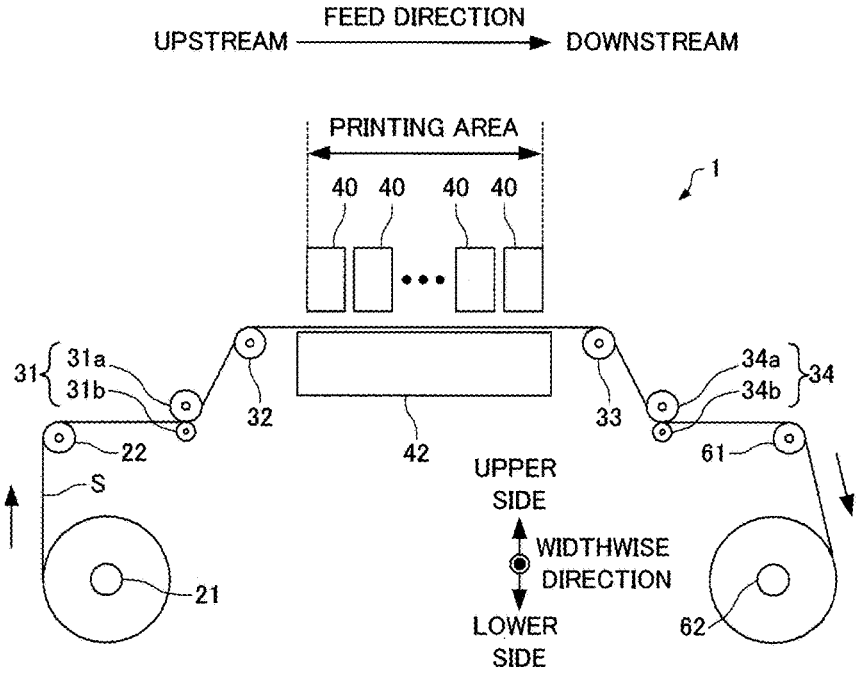
FIG. 2 is a schematic cross-sectional view illustrating a printer.

FIG. 2 is a schematic cross-sectional view illustrating the printer 1. In the example illustrated in FIG. 2, the paper S is a rolled sheet. Note that the recording medium on which the printer 1 prints an image is not limited to a rolled sheet, but may be a cut sheet.

The printer 1 includes a feed-out shaft 21 that is rotated to feed the paper S, and a relay roller 22 that guides the paper S fed from the feed-out shaft 21 to an upstream-side feed roller pair 31. The printer 1 includes a plurality of relay rollers 32 and 33 that guide the paper S, the upstream-side feed roller pair 31 that is disposed on the upstream side with respect to the printing area in the feed direction, and a downstream-side feed roller pair 34 that is disposed on the downstream side with respect to the printing area in the feed direction. The upstream-side feed roller pair 31 includes a driving roller 31*a* that is connected to and rotated by a motor (not illustrated in FIG. 2), and a driven roller 31*b* that rotates along with rotation of the drive roller 31*a*, and the downstream-side feed roller pair 34 includes a driving roller 34*a* that is connected to and rotated by a motor (not illustrated in FIG. 2), and a driven roller 34*b* that rotates along with rotation of the drive roller 34*a*. A feed force is applied to the paper S when the driving rollers 31*a* and 34*a* are rotated in a state in which the paper S is held by the upstream-side feed roller pair 31 and the downstream-side feed roller pair 34. The printer 1 also includes a relay roller 61 that guides the paper S fed from the downstream-side feed roller pair 34, and a winding drive shaft 62 around which the paper S fed from the relay roller 61 is wound. The paper S on which an image has been printed is wound around the winding drive shaft 62 along with rotation of the winding drive shaft 62. Note that the rollers and the motors correspond to the paper feed mechanism 30 illustrated in FIG. 1.

The printer 1 also includes the head unit 40, and a platen 42 that supports the paper S in the printing area from the side opposite to the printing side. The printer 1 may include a plurality of head units 40. For example, the head unit 40 may be provided corresponding to each ink color, and the printer 1 may have a configuration in which the head unit 40 that ejects a yellow (Y) ink, the head unit 40 that ejects a magenta (M) ink, the head unit 40 that ejects a cyan (C) ink, and the head unit 40 that ejects a black (K) ink are arranged in the feed direction. An example in which one head unit 40 is provided is described below on the assumption that each ink color is respectively assigned to each nozzle so that a color image can be printed.

Figure 3:
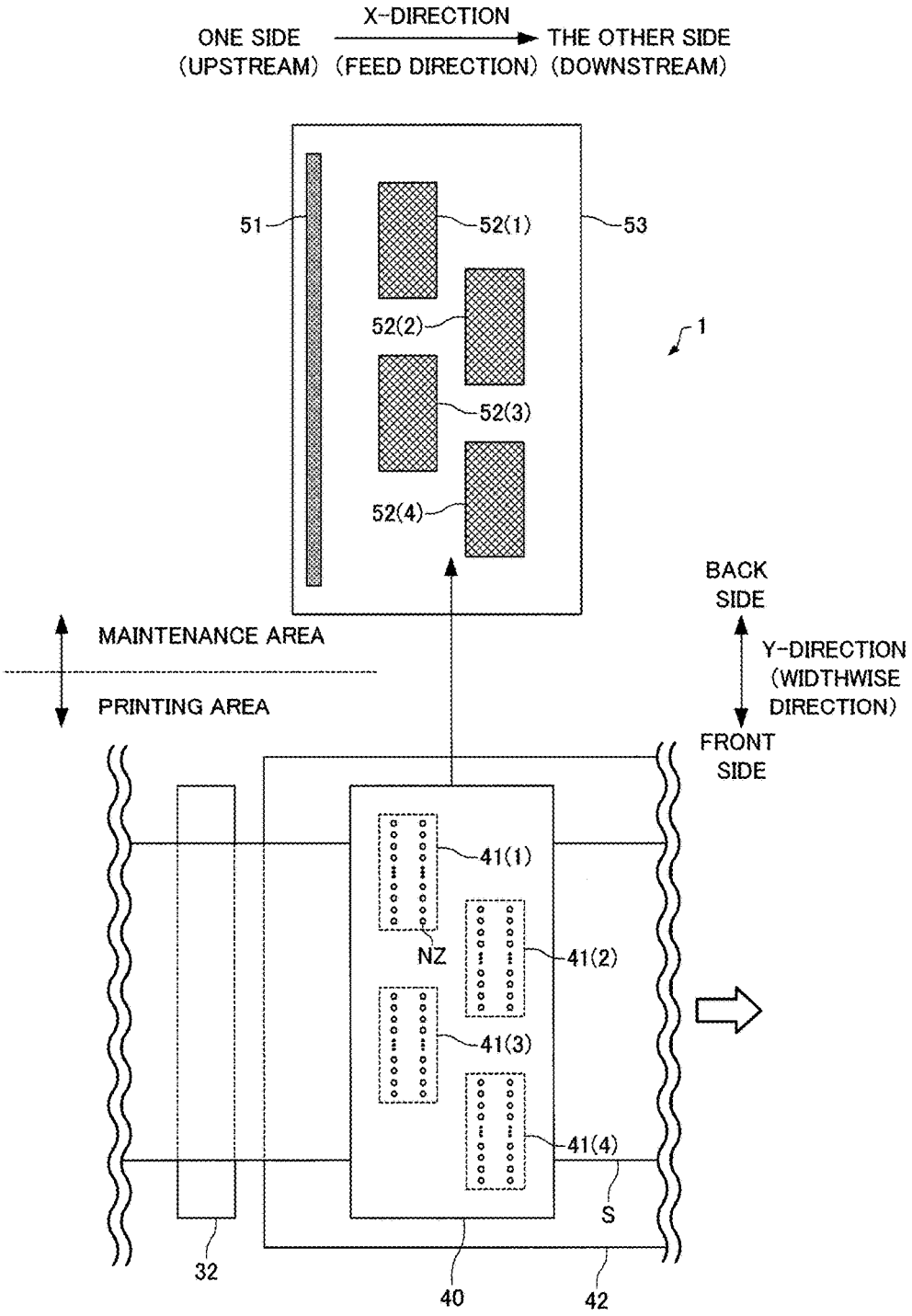
FIG. 3 is a schematic top view illustrating a printer.

As illustrated in FIG. 3, the head unit 40 has a configuration in which a plurality of heads 41(1) to 41(4) are arranged in the widthwise direction (Y-direction) of the paper S that intersects the feed direction of the paper S. The heads 41(1) to 41(4) are sequentially arranged from the back side to the front side in the Y-direction. A number of nozzles NZ that eject an ink are arranged on the side (lower side) of each head 41 that faces the paper S in the Y-direction at predetermined intervals. Note that FIG. 3 virtually illustrates the position of the head 41 and the position of the nozzle NZ when the head unit 40 is viewed from above. The positions of the nozzles NZ disposed at the end of the heads 41 (e.g., heads 41(1) and 41(2)) that are adjacent to each other in the Y-direction at least partially overlap each other. The nozzles NZ are arranged on the lower side of the head unit 40 in the Y-direction at predetermined intervals over a length equal to or larger than the width of the paper S. A two-dimensional image is printed on the paper S by causing the head unit 40 to eject an ink from the nozzles NZ onto the paper S that is continuously fed under the head unit 40.

Although FIG. 3 illustrates an example in which four heads 41 are provided to the head unit 40, the configuration is not limited thereto. The number of heads 41 may be larger than 4, or may be less than 4. Although FIG. 3 illustrates an example in which the heads 41 are disposed in a staggered arrangement, the configuration is not limited thereto. In one embodiment of the invention, the ink is ejected from the nozzle NZ using a piezo method that expands or shrinks the ink chamber by applying a voltage to the piezoelectric element PZT to eject the ink. Note that the ink may be ejected from the nozzle NZ using a thermal method that produces air bubbles in the nozzle NZ using a heater element, and ejects the ink utilizing the air bubbles.

In one embodiment of the invention, the paper S is supported on the horizontal side of the platen 42. Note that the configuration is not limited thereto. For example, a rotating drum that rotates around the widthwise direction of the paper S may be used as the platen 42, and the ink may be ejected from the head 41 while feeding the paper S that is guided by the rotating drum. In this case, the head unit 40 is tilted along the outer circumferential surface of the arc shape of the rotating drum. When the ink ejected from the head 41 is a UV ink that is cured upon application of ultraviolet rays, for example, an irradiator that applies ultraviolet rays may be provided on the downstream side of the head unit 40.

The printer 1 includes a maintenance area for cleaning the head unit 40. The maintenance area of the printer 1 includes a wiper 51, a plurality of caps 52, and an ink-receiving section 53. The maintenance area is situated on the back side of the platen 42 (i.e., printing area) in the Y-direction. The head unit 40 is moved to the back side in the Y-direction during cleaning.

The wiper 51 and the caps 52 are supported by the ink-receiving section 53, and can be moved in the X-direction (i.e., the feed direction of the paper S) using the ink-receiving section 53. The wiper 51 is a plate-shaped member that is vertically provided on the ink-receiving section 53. The wiper 51 is formed of an elastic member, a fabric, felt, or the like. The cap 52 is a member that is in the shape of a rectangular parallelepiped, and formed of an elastic member or the like. The cap 52 is provided corresponding to each head 41. The caps 52(1) to 52(4) are arranged in the widthwise direction corresponding to the arrangement of the heads 41(1) to 41(4) of the head unit 40. Therefore, when the head unit 40 is moved to the back side in the Y-direction, the head 41 faces the cap 52. When the head unit 40 is moved downward (or when the cap 52 is moved upward), the cap 52 adheres to the nozzle opening of the head 41 to seal the nozzle NZ. The ink-receiving section 53 receives the ink ejected from the nozzle NZ when cleaning the head 41.

When the ink is ejected from the nozzle NZ provided to the head 41, small ink droplets are produced together with the main ink droplets, and adhere to the nozzle opening of the head 41 as mist. Dust, paper powder, and the like also adhere to the nozzle opening of the head 41 in addition to the ink. If the head unit 40 is allowed to stand in a state in which such foreign substances adhere to the nozzle opening of the head 41, the nozzle NZ is clogged, and the ink may not be ejected from the nozzle NZ. Therefore, the printer 1 cyclically performs a wiping process in order to clean the head unit 40.

3. Drive Signal and Control Signal

The details of the drive signal COM and the control signal that are generated by the controller 10, and transmitted through the cable 20 are described below. The structure of the head 41 and the drive signal generation section 14 that are relevant to the drive signal COM and the control signal will be described first, and the configuration of the head control section HC will then be described in detail.

3.1. Structure of Head

Figure 4:
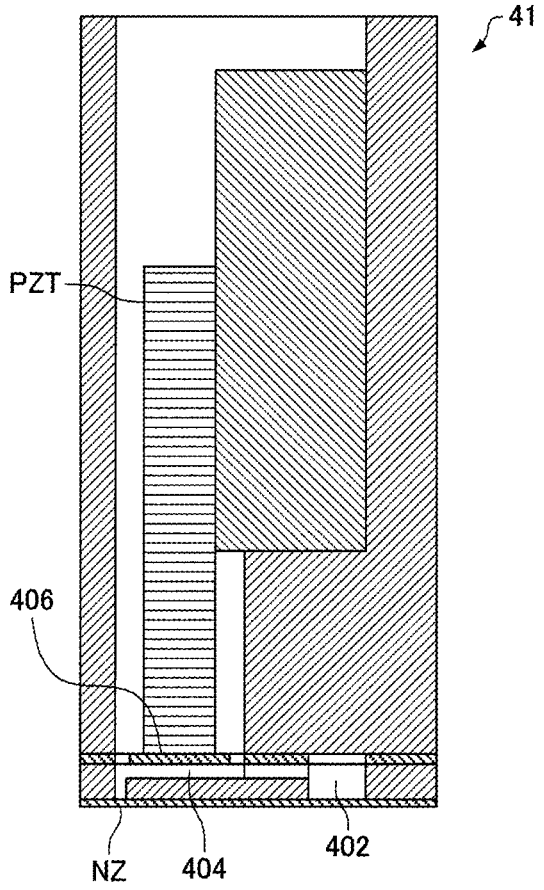
FIG. 4 is a diagram illustrating the structure of a head.

FIG. 4 is a diagram illustrating the structure of the head 41. The nozzle NZ, the piezoelectric element PZT, an ink supply passage 402, a nozzle communication passage 404, and an elastic plate 406 are illustrated in FIG. 4. The ink supply passage 402 and the nozzle communication passage 404 correspond to the cavity CA.

Ink droplets are supplied to the ink supply passage 402 from an ink tank (not illustrated in FIG. 4). The ink droplets are supplied to the nozzle communication passage 404. The drive waveform of the drive signal COM is applied to the piezoelectric element PZT. The piezoelectric element PZT is expanded and contracted (displaced) according to the drive waveform to vibrate the elastic plate 406. An ink droplet having a volume corresponding to the amplitude of the drive waveform is ejected from the nozzle NZ. The actuator sections including the nozzle NZ, the piezoelectric element PZT, and the like are arranged as illustrated in FIG. 3 to form the head 41 having a nozzle array.

3.2. Drive Signal Generation Section

Figure 5:
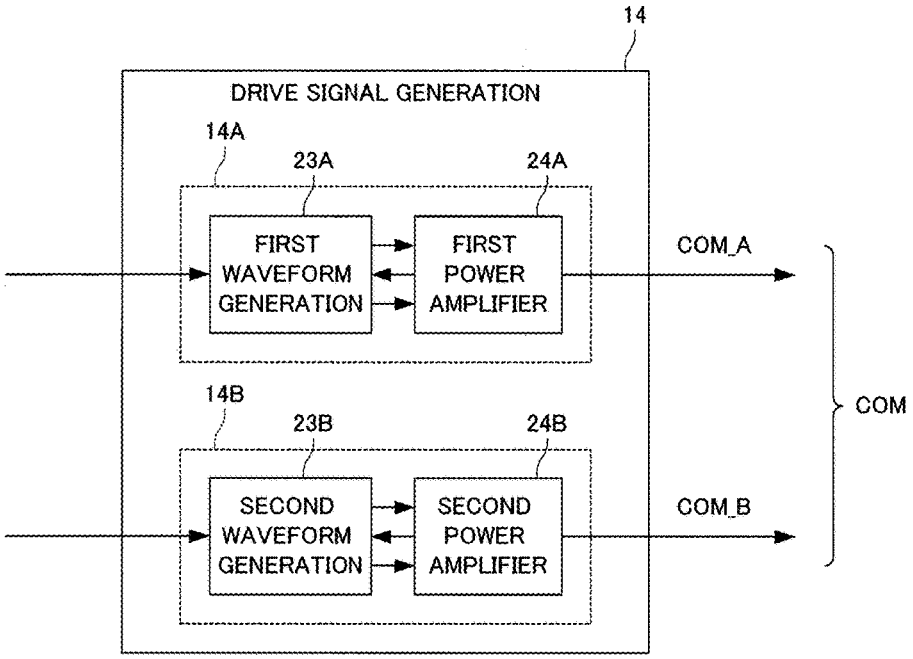
FIG. 5 is a block diagram illustrating the configuration of a drive signal generation section.

FIG. 5 is a block diagram illustrating the configuration of the drive signal generation section 14. The drive signal generation section 14 can simultaneously generate a plurality of drive signals COM. The drive signal generation section 14 according to one embodiment of the invention includes a first drive signal generation section 14A that generates a first drive signal COM_A, and a second drive signal generation section 14B that generates a second drive signal COM_B.

The first drive signal generation section 14A includes a first waveform generation circuit 23A that outputs a signal at a voltage corresponding to the received generation information, and a first power amplifier circuit 24A that amplifies the signal generated by the first waveform generation circuit 23A. The second drive signal generation section 14B includes a second waveform generation circuit 23B and a second power amplifier circuit 24B. Note that the first waveform generation circuit 23A and the second waveform generation circuit 23B have the same configuration, and the first power amplifier circuit 24A and the second power amplifier circuit 24B have the same configuration.

Figure 6:
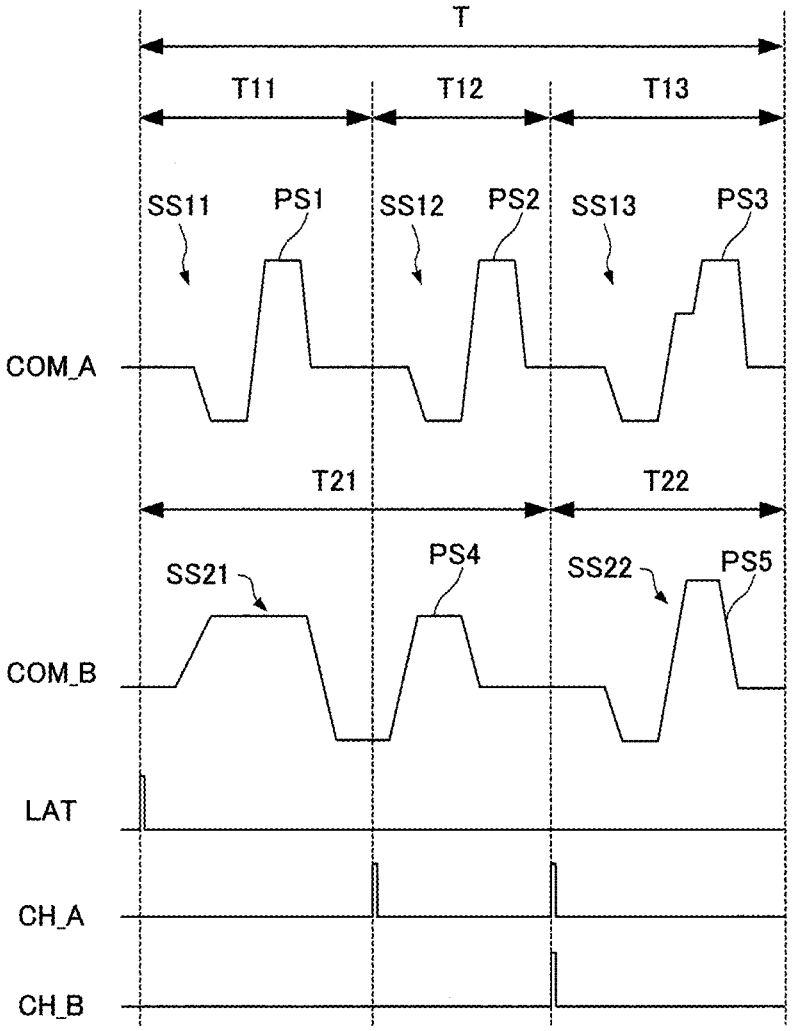
FIG. 6 is a diagram illustrating a first drive signal, a second drive signal, a latch signal, and a channel signal according to a related-art example.

The drive signal COM generated by the drive signal generation section 14 is described below. A drive signal COM according to a related-art example is described below as a comparative example, and the drive signal COM according to one embodiment of the invention is described later. A first drive signal COM_A and a second drive signal COM_B illustrated FIG. 6 are generated as the drive signal COM according to the related-art example. Note that the drive signal generation section 14 according to the related-art example is configured as illustrated FIG. 5, and the first drive signal generation section 14A and the second drive signal generation section 14B respectively generate the first drive signal COM_A and the second drive signal COM_B based on the generation information received from the CPU 12.

The first drive signal COM_A has a first waveform part SS11 that is generated in a period T11 within a cycle period T, a second waveform part SS12 that is generated in a period T12 within the cycle period T, and a third waveform part SS13 that is generated in a period T13 within the cycle period T, for example. The first waveform part SS11 has a drive waveform PS1. The second waveform part SS12 has a drive waveform PS2, and the third waveform part SS13 has a drive waveform PS3. The drive waveform PS1 and the drive waveform PS2 are applied to the piezoelectric element PZT when forming a large dot. The drive waveform PS3 is applied to the piezoelectric element PZT when forming a medium dot. A medium ink droplet is ejected from the head 41 (corresponding nozzle NZ) by applying the drive waveform PS3 to the piezoelectric element PZT.

The second drive signal COM_B has a first waveform part SS21 that is generated in a period T21, and a second waveform part SS22 that is generated in a period T22. The first waveform part SS21 has a drive waveform PS4, and the second waveform part SS22 has a drive waveform PS5. The drive waveform PS4 is applied to the piezoelectric element PZT when forming a small dot. A small ink droplet is ejected from the head 41 by applying the drive waveform PS4 to the piezoelectric element PZT. The drive waveform PS5 is applied to the piezoelectric element PZT when forming a large dot.

The first drive signal COM_A and the second drive signal COM_B according to the related-art example are designed so that each waveform part can be applied to the piezoelectric element PZT. Specifically, each waveform part of the first drive signal COM_A or the second drive signal COM_B can be selectively applied to the piezoelectric element PZT. It is also possible to apply part of the first drive signal COM_A and part of the second drive signal COM_B to the piezoelectric element PZT in combination. For example, the drive signal COM applied to the piezoelectric element PZT can be switched from the first drive signal COM_A to the second drive signal COM_B, and vice versa, at the start timing of the cycle period T (i.e., the timing of the latch waveform of the latch signal LAT). The drive signal COM applied to the piezoelectric element PZT can also be switched at the timing corresponding to the boundary between the second waveform part SS12 and the third waveform part SS13 of the first drive signal COM_A (i.e., the timing corresponding to the boundary between the first waveform part SS21 and the second waveform part SS22 of the second drive signal COM_B (i.e., the timing of the channel waveform of the first channel signal CH_A and the timing of the channel waveform of the second channel signal CH_B)).

Specifically, the drive signal COM has a configuration in which the drive waveforms (i.e., unit drive signals that are applied to the piezoelectric element PZT to discharge (eject) the liquid) are connected in time series. In the related-art example, the drive waveform of the first drive signal COM_A or the second drive signal COM_B is selectively used as the drive waveform of the drive signal COM. Note that the rising edge of the drive waveform corresponds to the timing at which the volume of the cavity CA that communicates with the nozzle is increased to suck the liquid, and the falling edge of the drive waveform corresponds to the timing at which the volume of the cavity CA is decreased to force the liquid to exit from the cavity CA so that the liquid is discharged from the nozzle NZ.

3.3. Head Control Section

Figure 7:
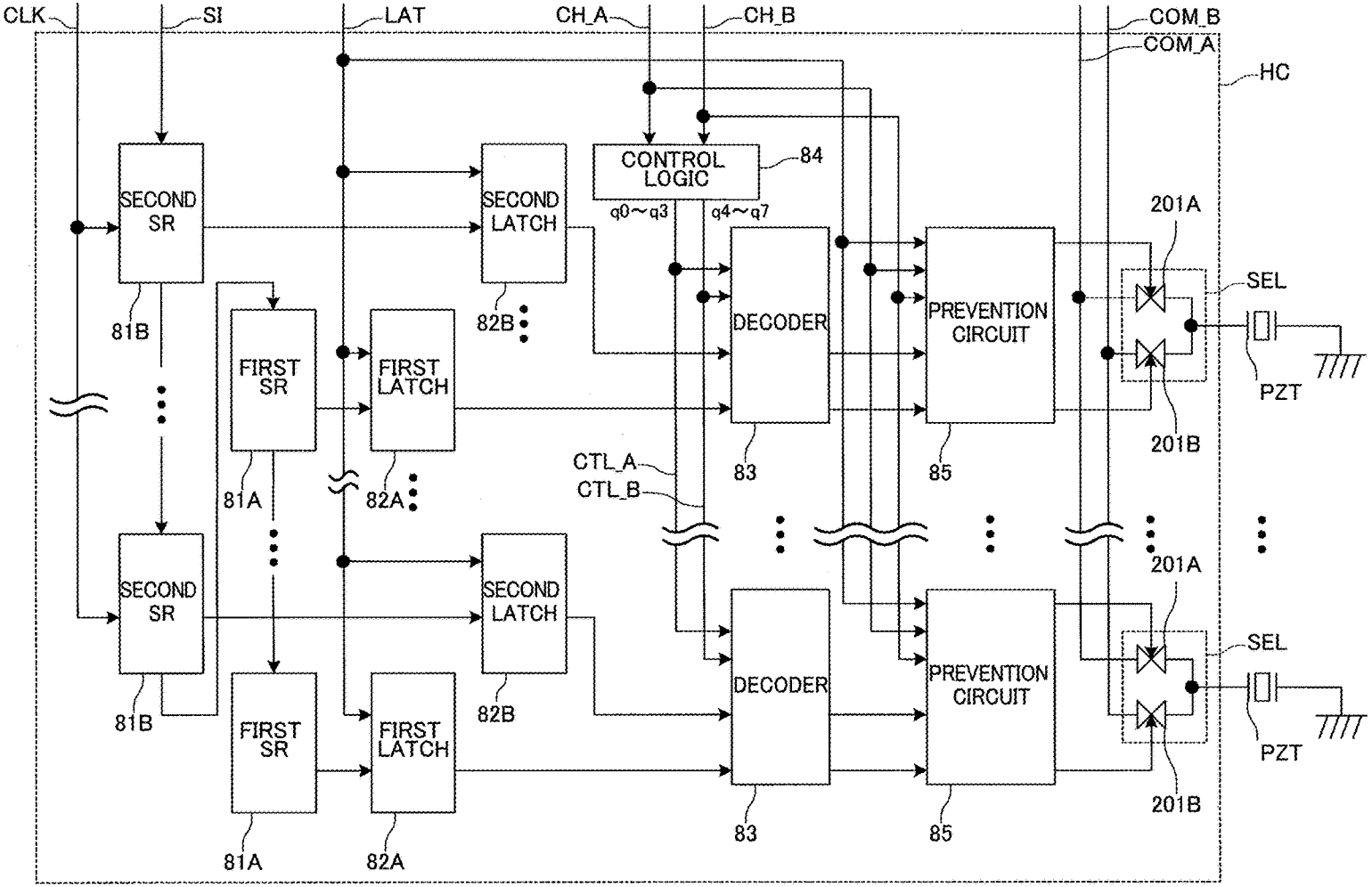
FIG. 7 is a block diagram illustrating the configuration of a head control section.

FIG. 7 is a block diagram illustrating the configuration of the head control section HC. As illustrated in FIG. 7, the head control section HC includes a first shift register 81A ("FIRST SR" in FIG. 7), a second shift register 81B ("SECOND SR" in FIG. 7), a first latch circuit 82A ("FIRST LATCH" in FIG. 7), a second latch circuit 82B ("SECOND LATCH" in FIG. 7), a decoder 83, a control logic 84, a prevention circuit 85, a first switch 201A, and a second switch 201B. Each section (first shift register 81A, second shift register 81B, first latch circuit 82A, second latch circuit 82B, decoder 83, prevention circuit 85, first switch 201A, and second switch 201B) excluding the control logic 84 is provided corresponding to each piezoelectric element PZT. Since the piezoelectric element PZT is provided corresponding to each nozzle NZ that ejects the ink, each section (first shift register 81A, second shift register 81B, first latch circuit 82A, second latch circuit 82B, decoder 83, prevention circuit 85, first switch 201A, and second switch 201B) is provided corresponding to each nozzle NZ. Note that the section that includes the first switch 201A and the second switch 201B, selects the drive waveform, and applies the selected drive waveform to the piezoelectric element PZT corresponds to the selection section according to one embodiment of the invention (SEL in FIG. 7).

The head control section HC performs the control process for ejecting the ink based on the pixel data SI from the control signal generation section 15. Specifically, the head control section HC controls the first switch 201A and the second switch 201B so that the desired part of the first drive signal COM_A or the second drive signal COM_B is selectively applied to the piezoelectric element PZT. In one embodiment of the invention, the pixel data SI is 2-bit data, and is transmitted to the head 41 in synchronization with the clock signal CLK. The higher-order bit of the pixel data SI is set to the first shift register 81A, and the lower-order bit of the pixel data SI is set to the second shift register 81B. The first latch circuit 82A is electrically connected to the first shift register 81A, and the second latch circuit 82B is electrically connected to the second shift register 81B. When the latch signal LAT from the control signal generation section 15 has been set to the H level, the first latch circuit 82A latches the higher-order bit of the pixel data SI, and the second latch circuit 82B latches the lower-order bit of the pixel data SI. The pixel data SI (i.e., a set of the higher-order bit and the lower-order-bit) latched by the first latch circuit 82A and the second latch circuit 82B is input to the decoder 83.

The decoder 83 decodes the pixel data SI based on the higher-order bit and the lower-order bit of the pixel data SI, and outputs a switch control signal for controlling the first switch 201A and the second switch 201B. The switch control signal is output based on a combination of selection data stored in the control logic 84 and the pixel data SI latched by the first latch circuit 82A and the second latch circuit 82B.

The control logic 84 and the selection data stored in the control logic 84 are described below. The control logic 84 may includes a plurality of registers that can store 1-bit data. Each register is formed by a delay flip-flop (D-FF) circuit, for example. Each register stores predetermined selection data. The registers may be disposed in a matrix so that four registers are arranged in the column direction (vertical direction), and eight registers are arranged in the row direction (transverse direction). The four registers that belong to the same column may be grouped to form groups q0 to q7 (from the left), and the groups q to q7 may be divided (classified) into a first register group (groups q0 to q3) and a second register group (groups q4 to q7).

Each register that belongs to the groups q0 to q3 can store the selection data for the first drive signal COM_A (hereinafter referred to as "first selection data"). Each register that belongs to the groups q4 to q7 can store the selection data for the second drive signal COM_B (hereinafter referred to as "second selection data"). Each register that belongs to the groups q0 and q4 may store the selection data corresponding to the pixel data SI [00]. Each register that belongs to the groups q1 and q5 may store the selection data corresponding to the pixel data SI [01]. Each register that belongs to the groups q2 and q6 may store the selection data corresponding to the pixel data SI [10]. Each register that belongs to the groups q3 and q7 may store the selection data corresponding to the pixel data SI [11]. The pixel data SI [00], the pixel data SI [01], the pixel data SI [10], and the pixel data SI [11] may respectively correspond to no dot (no dot is formed), a small dot, a medium dot, and a large dot in the related-art example.

The registers included in the first register group that belong to the same row and the registers included in the second register group that belong to the same row may be grouped so that each register can store the selection data for a specific waveform part. For example, the registers included in the first register group may be divided into groups G11 to G14, and the registers included in the second register group may be divided into groups G21 to G24.

For example, when the head control section HC having the configuration illustrated in FIG. 7 is used in the related-art example, each register that belongs to the group G11 can store the selection data for the first waveform part SS11 that is generated in the period T11 (see FIG. 6). Each register that belongs to the group G12 can store the selection data for the second waveform part SS12 that is generated in the period T12. Each register that belongs to the group G13 can store the selection data for the third waveform part SS13 that is generated in the period T13. Each register that belongs to the group G14 is not used since the first drive signal COM_A consists of three waveform parts in the example illustrated in FIG. 6.

Each register that belongs to the group G21 stores the selection data for the first waveform part SS21 that is generated in the period T21, and each register that belongs to the group G22 stores the selection data for the second waveform part SS22 that is generated in the period T22. Each register that belongs to the group G23 and each register that belongs to the group G24 are not used in the example illustrated in FIG. 6.

According to the above configuration, each register included in the control logic 84 stores appropriate selection data corresponding to a combination of the corresponding drive signal type (first drive signal COM_A or second drive signal COM_B), the corresponding pixel data SI ([00] to [11]), and the corresponding waveform (e.g., first waveform part SS11 or second waveform part SS22 in the example illustrated in FIG. 6).

The selection data stored in these registers is sequentially selected at the timing specified by the latch waveform of the latch signal LAT, the channel waveform of the first channel signal CH_A, and the channel waveform of the second channel signal CH_B. The selection data that has been appropriately selected is output through a control signal line group CTL_A for the first drive signal COM_A and a control signal line group CTL_B for the second drive signal COM_B as the first selection data for the first drive signal COM_A and the second selection data for the second drive signal COM_B.

The decoder 83 is described below. The decoder 83 selects data corresponding to the latched pixel data SI from the first selection data and the second selection data, and outputs the selected data as the switch control signal. The decoder 83 may output two switch control signals (first switch control signal and second switch control signal) that respectively correspond to the first switch 201A and the second switch 201B. The first selection data corresponding to the latched pixel data SI is output as the first switch control signal. The second selection data corresponding to the latched pixel data SI is output as the second switch control signal.

The first switch control signal and the second switch control signal output from the decoder 83 are respectively input to the first switch 201A and the second switch 201B to switch the first switch 201A and the second switch 201B between the ON state and the OFF state. The first drive signal COM_A from the drive signal generation section 14 is applied to the input of the first switch 201A, and the second drive signal COM_B from the drive signal generation section 14 is applied to the input of the second switch 201B. The piezoelectric element PZT is electrically connected to the common output of the first switch 201A and the second switch 201B. The first switch 201A and the second switch 201B are provided corresponding to each drive signal COM. For example, the waveform parts SS11 to SS13 of the first drive signal COM_A and the waveform parts SS21 and SS22 of the second drive signal COM_B (see FIG. 6) can be selectively applied to the piezoelectric element PZT.

The piezoelectric element PZT behaves like a capacitor. Therefore, when application of the drive signal COM has been stopped, the piezoelectric element PZT maintains the potential immediately before application of the drive signal COM is stopped. Accordingly, when application of the drive signal COM is stopped, the piezoelectric element PZT maintains the deformation state immediately before application of the drive signal COM is stopped.

As illustrated in FIG. 7, the prevention circuit 85 may be provided between the decoder 83 and the first switch 201A and the second switch 201B. The prevention circuit 85 is provided to prevent a situation in which the first drive signal COM_A and the second drive signal COM_B are simultaneously applied to one piezoelectric element PZT. Specifically, the prevention circuit 85 temporarily sets both the first switch 201A and the second switch 201B to the OFF state when the drive signal COM applied to the piezoelectric element PZT is switched from one of the first drive signal COM_A and the second drive signal COM_B to the other of the first drive signal COM_A and the second drive signal COM_B.

4. Control Process According to One Embodiment of the Invention 4.1. Problems that Occur in Related-Art Example Even when a liquid droplet having an identical volume is ejected from the nozzle NZ, residual vibrations after ejection may affect the subsequent ejection, and the placement timing may differ between the case where the first liquid droplet is ejected (first ejection) and the case where the second or subsequent liquid droplet is ejected (subsequent ejection). In particular, since it is difficult to provide an ejection interval that ensures that the residual vibrations stop when liquid droplets are ejected at high speed for implementing high-speed printing, the placement timing is significantly affected.

Figure 8A:
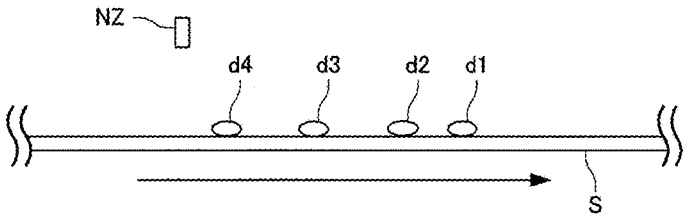
FIGS. 8A and 8B are diagrams illustrating the placement timing of the first ejection and the subsequent ejection.
Figure 8B:
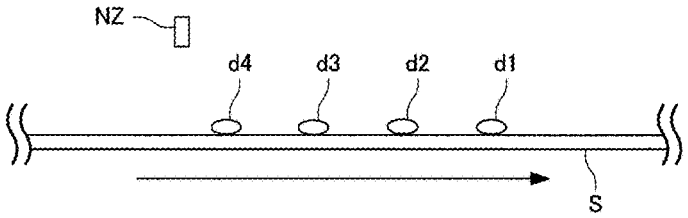

FIGS. 8A and 8B are diagrams illustrating the placement timing of the first ejection and the subsequent ejection. According to the example (related-art example) illustrated in FIG. 6, a large ink droplet that can form a large dot is ejected from the nozzle NZ corresponding to one drive waveform pattern (i.e., drive waveform PS1+drive waveform PS2+drive waveform PS5), for example. Therefore, the drive waveform pattern is identical between the first ejection and the subsequent ejection. However, the placement timing differs between the first ejection that is not affected by residual vibrations and the subsequent ejection that is affected by residual vibrations. FIG. 8A illustrates the placement position d1 of the first ejection from the nozzle NZ, and the placement positions d2 to d4 of the subsequent ejection when the paper S is fed in the rightward direction at a constant speed. In the related-art example, the placement timing of the subsequent ejection advances due to the effect of residual vibrations. Therefore, the interval between the placement position d1 and the placement position d2 is short as compared with the interval between the placement position d2 and the placement position d3, for example. In particular, when ejecting a large ink droplet that can form a large dot from the nozzle NZ, displacement (shift in position) occurs to a large extent as compared with the case of forming a medium dot or small dot. Specifically, since the quality of printed matter is significantly affected when ejecting a large ink droplet, it is preferable to use a different drive waveform corresponding the first ejection and the subsequent ejection at least when ejecting a large ink droplet. For example, it is preferable to ensure that the interval between the placement position d1 and the placement position d2 is equal to the interval between the placement position d2 and the placement position d3, for example (see FIG. 8B), by advancing the placement timing of the first ejection as compared with the subsequent ejection by utilizing a different drive waveform. FIG. 8A illustrates an example in which a liquid droplet is not ejected at a timing that precedes the timing of the first ejection. The placement timing also varies when a medium ink droplet (or small ink droplet) is ejected at a timing that precedes the timing of the first ejection.

When a third drive signal is separately provided for generating the drive waveform for the first ejection, it is necessary to provide a third drive signal generation section in addition to the first drive signal generation section 14A and the second drive signal generation section 14B. However, this is not a practical solution since the circuit scale increases to a large extent. A waveform part (drive waveform) may be added to the first drive signal COM_A or the second drive signal COM_B, and the waveform part may be appropriately selected corresponding to the first ejection and the subsequent ejection. However, since the cycle period T is short when liquid droplets are ejected at high speed for implementing high-speed printing, it is normally difficult to provide an additional waveform part. Even granted that it is possible to provide an additional waveform part, the period from the timing of the latch waveform of the latch signal LAT to the timing of the channel waveform of the channel signal CH differs between the first ejection and the subsequent ejection when ejecting a large ink droplet. For example, when an additional waveform part is provided to the first drive signal COM_A before the first waveform part SS11 (see FIG. 6 (related-art example)), and selected corresponding to the first ejection instead of the first waveform part SS11, the timing of the channel waveform of the first channel signal CH_A differs between the first ejection and the subsequent ejection when ejecting a large ink droplet. Therefore, the control process becomes very complex, and the load imposed on the control signal generation section 15 and the CPU 12 (hereinafter referred to as "CPU 12 and the like") increases.

The printer 1 according to one embodiment of the invention can adjust the placement timing of the first ink droplet and the subsequent ink droplet to improve the quality of printed matter without increasing the circuit scale and the load imposed on the CPU 12 and the like (i.e., without changing the timing of the channel signal CH), by utilizing the waveforms as described below taking account of the fact that the drive waveform has a common part when applied to the first ejection and the subsequent ejection.

4.2. Drive Signal According to One Embodiment of the Invention

Figure 9:
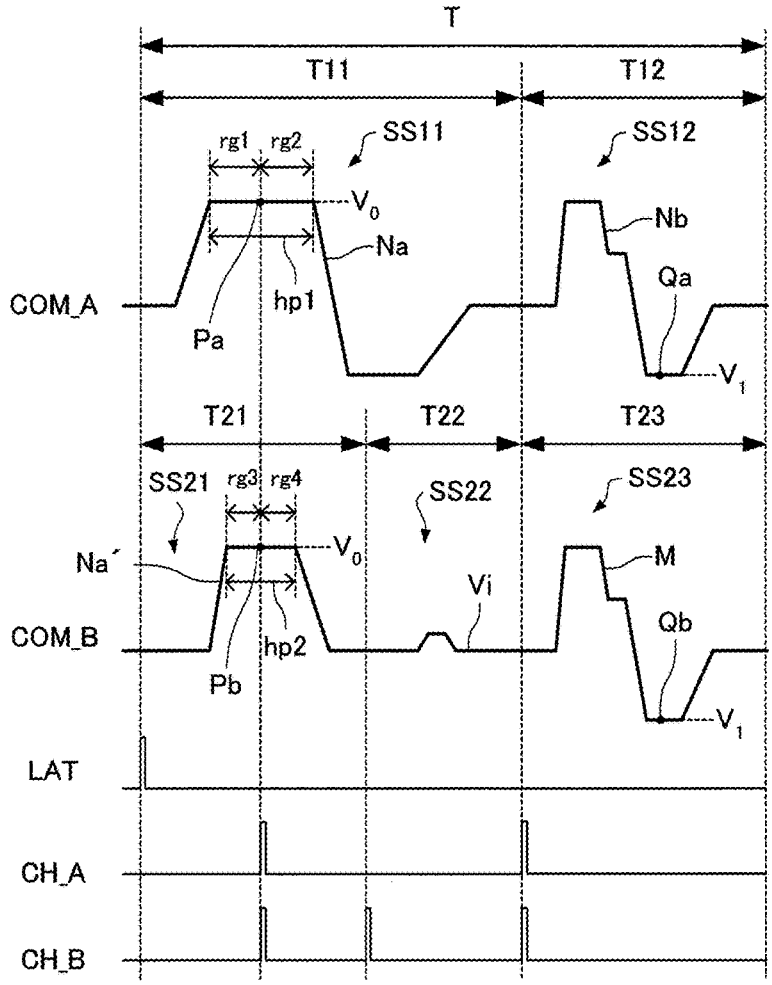
FIG. 9 is a diagram illustrating a first drive signal, a second drive signal, a latch signal, and a channel signal according to one embodiment of the invention.

FIG. 9 is a diagram illustrating a first drive signal COM_A, a second drive signal COM_B, a latch signal LAT, a first channel signal CH_A, and a second channel signal CH_B according to one embodiment of the invention. Note that the same elements as those illustrated in FIG. 6 are indicated by the same reference signs, and detailed description thereof is omitted.

The first drive signal COM_A has a first waveform part SS11 that is generated in a period T11 within a cycle period T, and a second waveform part SS12 that is generated in a period T12 within the cycle period T. The first waveform part SS11 has a drive waveform Na. The second waveform part SS12 has a drive waveform Nb. The drive waveform Na and the drive waveform Nb are applied to the piezoelectric element PZT when ejecting the "subsequent" large ink droplet. Note that the subsequent large ink droplet corresponds to the second liquid droplet.

The second drive signal COM_B has a first waveform part SS21 that is generated in a period T21, a second waveform part SS22 that is generated in a period T22, and a second waveform part SS23 that is generated in a period T23. The first waveform part SS21 has a drive waveform Na', the second waveform part SS22 has a drive waveform Vi, and the second waveform part SS23 has a drive waveform M. The drive waveform Vi is applied to the piezoelectric element PZT for finely vibrating the piezoelectric element PZT without ejecting a liquid droplet. The drive waveform M is applied to the piezoelectric element PZT when ejecting a medium ink droplet. Note that the medium ink droplet corresponds to the third liquid droplet. The ejection volume of the medium ink droplet is smaller than that of the large ink droplet.

The drive waveform Na of the first drive signal COM_A has a first holding part hp1. The first holding part hp1 maintains the first drive signal COM_A at a potential $V_0$ (corresponding to the predetermined potential), and is divided by a boundary point Pa into a first part rg1 and a second part rg2 (see FIG. 9). The drive waveform Na' of the second drive signal COM_B has a second holding part hp2. The second holding part hp2 maintains the second drive signal COM_B at the potential $V_0$, and is divided by a boundary point Pb into a third part rg3 and a fourth part rg4 (see FIG. 9). As illustrated in FIG. 9, at least the third part rg3 and the first part rg1 differ in period (length), and the slope (increase in voltage) of the drive waveform that precedes the first part rg1 differs from the slope (increase in voltage) of the drive waveform that precedes the third part rg3.

The liquid suction amount, the liquid suction speed, the liquid expulsion amount, and the liquid expulsion speed can be changed, and the liquid placement timing can be adjusted by changing the slope (increase/decrease in voltage) of the drive waveform. In the related-art example, the drive signal COM is switched only at the timing corresponding to the boundary between the waveform parts. When the first drive signal COM_A and the second drive signal COM_B are identical in potential, a change in potential does not occur even if the drive signal COM is switched at a timing other than the timing corresponding to the boundary between the waveform parts. In one embodiment of the invention, the part of the drive waveform Na' of the second drive signal COM_B that precedes the third part rg3, the third part rg3 of the drive waveform Na' of the second drive signal COM_B, the second part rg2 of the drive waveform Na of the first drive signal COM_A, the part of the drive waveform Na of the first drive signal COM_A that follows the second part rg2, and the drive waveform Nb are applied to the piezoelectric element PZT when ejecting the "first" large ink droplet.

Figure 10:
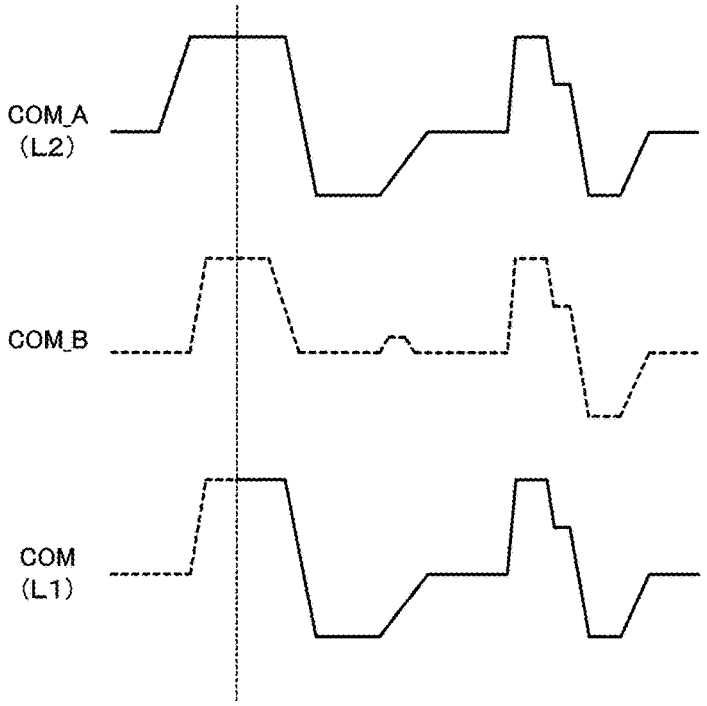
FIG. 10 is a diagram illustrating specific examples of a first drive waveform and a second drive waveform.

FIG. 10 is a diagram illustrating the drive waveform (corresponding to the first drive waveform) that ejects the first large ink droplet (corresponding to the first liquid droplet). In FIG. 10, the first drive signal COM_A is drawn using a solid line (see the upper drive signal), and the second drive signal COM_B is drawn using a dotted line (see the middle drive signal). The drive waveform that ejects the first large ink droplet is illustrated in the lower part in FIG. 10. The part of the drive waveform that is drawn using a dotted line corresponds to the part of the drive waveform Na' of the second drive signal COM_B that precedes the third part rg3, and the remaining part (solid line) corresponds to the first drive signal COM_A. The drive waveform (corresponding to the second drive waveform) that ejects the subsequent large ink droplet (corresponding to the second liquid droplet) is the same as the waveform of the first drive signal COM_A that is drawn using a solid line in FIG. 10. Specifically, the drive waveform that ejects the subsequent large ink droplet consists of the part of the drive waveform Na of the first drive signal COM_A that precedes the first part rg1, the first part rg1 of the drive waveform Na of the first drive signal COM_A, the second part rg2 of the drive waveform Na of the first drive signal COM_A, the part of the drive waveform Na of the first drive signal COM_A that follows the second part rg2, and the drive waveform Nb.

According to one embodiment of the invention, the drive waveform that ejects the first large ink droplet can be generated without separately providing the drive signals corresponding to the first ejection and the subsequent ejection, by switching the drive waveform (including a timing other than the timing corresponding to the boundary between the waveform parts) as described above. As illustrated in FIG. 9, the period from the timing of the latch waveform of the latch signal LAT to the timing of the channel waveform of the channel signal CH can be made identical between the case of ejecting the first large ink droplet and the case of ejecting the subsequent large ink droplet.

In one embodiment of the invention, the drive signal is switched between the first drive signal COM_A and the second drive signal COM_B in the holding part (first holding part hp1 and second holding part hp2) that maintains a state in which the volume of the cavity CA is large. Since the drive signal can be switched at an interval that can be adjusted within the range of the holding part before a liquid droplet is ejected, the placement timing can be appropriately controlled while preventing a situation in which the ejection operation is affected by switching noise or the like. Note that the drive signal may be switched as described above in a holding part that maintains a state in which the volume of the cavity CA is small. For example, the boundary points Qa and Qb illustrated in FIG. 9 are included in a holding part in which the first drive signal COM_A and the second drive signal COM_B are maintained at the potential $V_1$, and may be used instead of the boundary points Pa and Pb, respectively. In this case, a change in potential does not occur when switching the drive signal. Note that the state in which the volume of the cavity CA is large may be a state in which the volume of the cavity CA is a maximum, or a state in which the volume of the cavity CA is a maximum within a given period. The state in which the volume of the cavity CA is small may be a state in which the volume of the cavity CA is a minimum, or a state in which the volume of the cavity CA is a minimum within a given period.

4.3. Flowchart

Figure 11:
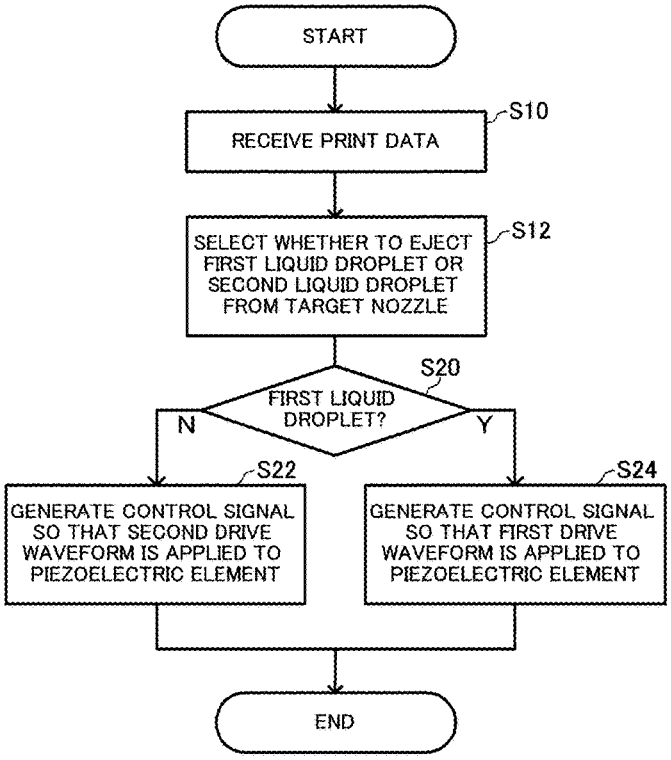
FIG. 11 is a flowchart illustrating a liquid ejecting method.

FIG. 11 is a flowchart illustrating the liquid ejecting method implemented by the CPU 12 and the like according to one embodiment of the invention. Note that FIG. 11 illustrates the process that ejects the first large ink droplet and the subsequent large ink droplet. The CPU 12 and the like receive the print data 111 (S10), and select whether to eject the first liquid droplet (first large ink droplet) or the second liquid droplet (subsequent large ink droplet) from the target nozzle NZ (S12). The CPU 12 and the like may acquire information that represents whether or not the target nozzle has ejected a large ink droplet at the preceding ejection timing, and select whether to eject the first liquid droplet or the second liquid droplet from the target nozzle.

When the CPU 12 and the like have selected to eject the first liquid droplet (S20, Y), the CPU 12 and the like generate the control signal so that the first drive waveform (i.e., the part of the drive waveform Na' of the second drive signal COM_B that precedes the third part rg3, the third part rg3 of the drive waveform Na' of the second drive signal COM_B, the second part rg2 of the drive waveform Na of the first drive signal COM_A, the part of the drive waveform Na of the first drive signal COM_A that follows the second part rg2, and the drive waveform Nb) is applied to the piezoelectric element PZT (S24).

When the CPU 12 and the like have selected to eject the second liquid droplet (S20, N), the CPU 12 and the like generate the control signal so that the second drive waveform (i.e., the part of the drive waveform Na of the first drive signal COM_A that precedes the first part rg1, the first part rg1 of the drive waveform Na of the first drive signal COM_A, the second part rg2 of the drive waveform Na of the first drive signal COM_A, the part of the drive waveform Na of the first drive signal COM_A that follows the second part rg2, and the drive waveform Nb) is applied to the piezoelectric element PZT (S22).

As described above, the printer 1 and the head unit 40 according to one embodiment of the invention can adjust the placement timing of the first ink droplet and the subsequent ink droplet to improve the quality of printed matter without increasing the circuit scale and the load imposed on the CPU 12 and the like, by causing the CPU 12 and the like to perform the control process according to the flowchart illustrated in FIG. 11 using the first drive signal COM_A, the second drive signal COM_B, and the like illustrated in FIG. 9.

Note that the application of the embodiment of the invention is not limited to a line head liquid ejecting device. The above advantageous effects can also be obtained when the embodiment of the invention is applied to a liquid-jet printing device for which it is desired to simultaneously drive a number of piezoelectric elements PZT.

The invention includes various other configurations substantially the same as the configurations described in connection with the embodiments and the application examples (such as a configuration having the same function, method, and results, or a configuration having the same objective and results). The invention also includes a configuration in which an unsubstantial section (element) described in connection with the embodiments and the like is replaced with another section (element). The invention also includes a configuration having the same effects as those of the configurations described in connection with the embodiments and the like, or a configuration capable of achieving the same objective as that of the configurations described in connection with the above embodiments and the like. The invention further includes a configuration in which a known technique is added to the configurations described in connection with the embodiments and the like.

Although only some embodiments of the invention have been described in detail above, those skilled in the art would readily appreciate that many modifications are possible in the embodiments without materially departing from the novel teachings and advantages of the invention. Accordingly, all such modifications are intended to be included within the scope of the invention.

What is claimed is:

1. A liquid ejecting device comprising:

a piezoelectric element that is deformed by applying at least one drive waveform among a plurality of drive waveforms to the piezoelectric element, the plurality of drive waveforms including a first drive waveform and a second drive waveform that differs from the first drive waveform;

a cavity that is filled with a liquid and is increased or decreased in internal pressure due to deformation of the piezoelectric element;

a nozzle that communicates with the cavity and ejects the liquid as a liquid droplet through increase and decrease in the internal pressure of the cavity; and a selection section that selects at least one drive waveform from the plurality of drive waveforms, and applies a selected drive waveform to the piezoelectric element, the nozzle ejecting a first liquid droplet when the first drive waveform has been selected by the selection section and applied to the piezoelectric element, and the nozzle ejecting a second liquid droplet when the second drive waveform has been selected by the selection section and applied to the piezoelectric element, an ejection volume of the first liquid droplet being equal to an ejection volume of the second liquid droplet, the nozzle ejecting no liquid droplet at an ejection timing that precedes an ejection timing for the first liquid droplet, the piezoelectric element being displaced by selectively applying part or entirety of a first drive signal and part or entirety of a second drive signal that differs from the first drive signal to the piezoelectric element, and the first drive waveform including part of the second drive signal and part of the first drive signal.

2. The liquid ejecting device as defined in claim 1, the first drive waveform and the second drive waveform differing in slope.

3. The liquid ejecting device as defined in claim 1, the first drive signal having a first holding part that holds a predetermined potential, the first holding part including a first part and a second part that follows the first part, the second drive signal having a second holding part that holds the predetermined potential, the second holding part including a third part and a fourth part that follows the third part, the third part differing in period from the first part, the first liquid droplet being ejected from the nozzle when the first drive waveform including the third part and the second part has been applied to the piezoelectric element, and the second liquid droplet being ejected from the nozzle when the second drive waveform including the first part and the second part has been applied to the piezoelectric element.

4. A head unit comprising:

a piezoelectric element that is deformed by applying at least one drive waveform among a plurality of drive waveforms to the piezoelectric element, the plurality of drive waveforms including a first drive waveform and a second drive waveform that differs from the first drive waveform;

a cavity that is filled with a liquid and is increased or decreased in internal pressure due to deformation of the piezoelectric element;

a nozzle that communicates with the cavity and ejects the liquid as a liquid droplet through increase and decrease in the internal pressure of the cavity; and a selection section that selects at least one drive waveform from the plurality of drive waveforms, and applies a selected drive waveform to the piezoelectric element, the nozzle ejecting a first liquid droplet ejected when the first drive waveform has been selected by the selection section and applied to the piezoelectric element, and the nozzle ejecting a second liquid droplet when the second drive waveform has been selected by the selection section and applied to the piezoelectric element, an ejection volume of the first liquid droplet being equal to an ejection volume of the second liquid droplet, the nozzle ejecting no liquid droplet at an ejection timing that precedes an ejection timing for the first liquid droplet, the piezoelectric element being displaced by selectively applying part or entirety of a first drive signal and part or entirety of a second drive signal that differs from the first drive signal to the piezoelectric element, and the first drive waveform including part of the second drive signal and part of the first drive signal.

5. A liquid ejecting method for a liquid ejecting device that includes a piezoelectric element that is deformed by applying at least one drive waveform among a plurality of drive waveforms to the piezoelectric element, the plurality of drive waveforms including a first drive waveform and a second drive waveform that differs from the first drive waveform, a cavity that is filled with a liquid and is increased or decreased in internal pressure due to deformation of the piezoelectric element, and a nozzle that communicates with the cavity and ejects the liquid as a liquid droplet through increase and decrease in the internal pressure of the cavity, the liquid ejecting method comprising:

selecting whether to eject a first liquid droplet or a second liquid droplet from the nozzle, an ejection volume of the first liquid droplet being equal to an ejection volume of the second liquid droplet;

applying the first drive waveform to the piezoelectric element when ejecting the first liquid droplet; and applying the second drive waveform to the piezoelectric element when ejecting the second liquid droplet, the nozzle ejecting no liquid droplet at an ejection timing that precedes an ejection timing for the first liquid droplet, the piezoelectric element being displaced by selectively applying part or entirety of a first drive signal and part or entirety of a second drive signal that differs from the first drive signal to the piezoelectric element, and the first drive waveform including part of the second drive signal and part of the first drive signal.

* * * * *